US007549638B2

(12) United States Patent
Norman

(10) Patent No.: US 7,549,638 B2
(45) Date of Patent: Jun. 23, 2009

(54) DICE WITH OPENING FACE

(75) Inventor: Casey William Norman, Andoversford (GB)

(73) Assignee: Genie Toys PLC (GB)

( * ) Notice: Subject to any disclaimer, the term of this patent is extended or adjusted under 35 U.S.C. 154(b) by 289 days.

(21) Appl. No.: 11/579,322

(22) PCT Filed: May 27, 2005

(86) PCT No.: PCT/GB2005/002125

§ 371 (c)(1),
(2), (4) Date: Nov. 1, 2006

(87) PCT Pub. No.: WO2005/118091

PCT Pub. Date: Dec. 15, 2005

(65) Prior Publication Data

US 2008/0272542 A1 Nov. 6, 2008

(30) Foreign Application Priority Data

Jun. 1, 2004 (GB) ..... 0412176.0

(51) Int. Cl.
*A63F 9/04* (2006.01)

(52) U.S. Cl. ..... 273/146; D21/373; D21/372

(58) Field of Classification Search ..... 273/146; D21/373, 372
See application file for complete search history.

(56) References Cited

U.S. PATENT DOCUMENTS

| | | | | |
|---|---|---|---|---|
| 3,544,112 | A | 12/1970 | Cornblatt | |
| 3,907,103 | A | 9/1975 | Shaw | |
| 4,678,191 | A | 7/1987 | Mills et al. | |
| 5,505,458 | A * | 4/1996 | Blokh et al. | 273/299 |
| 6,659,459 | B2 | 12/2003 | Dewa et al. | |

FOREIGN PATENT DOCUMENTS

| | | |
|---|---|---|
| EP | 0 391 459 A2 | 10/1990 |
| GB | 2 220 920 A | 1/1990 |

* cited by examiner

*Primary Examiner*—Benjamin H Layno
(74) *Attorney, Agent, or Firm*—DLA Piper LLP (US)

(57) ABSTRACT

A die having a regular polyhedral form, at least one opening face of the die being hinged to an adjacent hinge face such that the at least one opening face can be opened by pressing on at least one pressure face adjacent to the at least one opening face.

6 Claims, 1 Drawing Sheet

DICE WITH OPENING FACE

RELATED APPLICATION

This is a §371 of International Application No. PCT/GB2005/002125, with an international filing date of May 27, 2005 (WO 2005/118091 A1, published Dec. 15, 2005), which is based on British Patent Application No. GB 0412176.0, filed Jun. 1, 2004.

TECHNICAL FIELD

The disclosure relates to a die having a regular polyhedral form.

BACKGROUND

It is well known to provide a polyhedral die in which when the die is thrown the probability of any of the faces facing upwards when the die come to rest is equal. U.S. Pat. No. B2-6,659,459 describes a die capable of being opened. However, an opening mechanism for the die comprises a button on the face to be opened first, which button destroys the symmetry of the die.

It could therefore be helpful to provide an openable die in which an object can be concealed and subsequently revealed to allow for novel and amusing games.

SUMMARY

I provide a die having a regular polyhedral form, at least one opening face of the die being hinged to an adjacent hinge face such that the at least one opening face can be opened by pressing on at least one further pressure face adjacent to the at least one face.

The at least one opening face and the at least one pressure face adjacent thereto may be provided with interacting cam surfaces to force the at least one opening outwards when the at least one pressure face is pressed inwards.

The die may comprise a latch for retaining the at least one opening face closed. Biasing means for biasing the at least one opening face outwards may be provided, such as a helical spring at the hinge with the hinge face.

The die may include a cavity for containing an object, opened when the opening face is opened and may be substantially hollow.

Representative embodiments of dice include dice substantially having the form of a cube, an octahedron, a dodecahedron and an icosahedron, for example.

BRIEF DESCRIPTION OF THE DRAWINGS

In order that the disclosure may be more readily understood, a specific embodiment thereof will now be described in more detail, by way of example only, and with reference to the accompanying drawings, in which.

DETAILED DESCRIPTION

The figures show a die substantially in the form of a cube, but having circular faces and radiused corners and edges. In the following description, reference to the "front", "back", "sides" and "base" of the die are non-limiting and merely refer to certain faces of the die in the position shown in FIGS. 1, 2 and 3.

Figure 1:
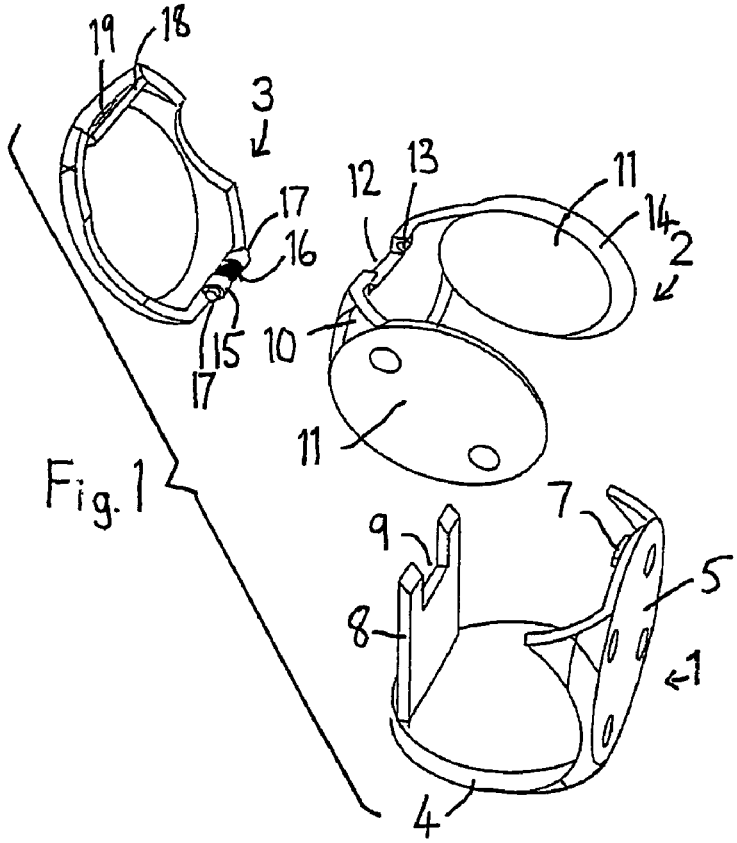
FIG. 1 is an exploded view of a die.

FIG. 1 shows three component parts of a die, namely a front-and-base 1, a back-and-sides 2 and an opening face or lid 3.

The front-and-base 1 comprises a base face 4 and a front face 5 at right angles thereto. Vertical sides of the front face 5 are provided with cam surfaces 6, shown in FIGS. 4*a* and 4*b*. A tongue 7 extends inwardly from the upper edge of front face 5. A flat projection 8 extends upwardly from the rear of the base face 4 and a recess 9 is formed in the upper edge of the projection.

Figure 4A:
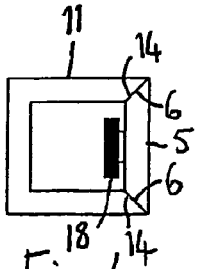
FIGS. 4*a* and 4*b* show schematically how the die is opened.
Figure 4B:
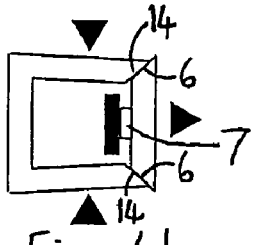

The back-and-sides 2 comprises a back face 10 and pressure faces or side faces 11 at right angles thereto. The back face 10 has a horizontal elongate recess 12 in its upper edge. Ends of the recess 12 are provided with indentations 13, only one of which is visible in FIG. 1. Side faces 11 have cam surfaces 14 as shown in FIGS. 4*a* and 4*b*.

The lid 3 comprises an axle 15 at a rear edge thereof (the lowermost edge as shown in FIG. 1), the axle carrying a coil spring 16. Ends of the axle are formed as hinge pins 17. A latch plate 18 depends from the front edge of lid 3 and comprises a hole 19.

Figure 2:
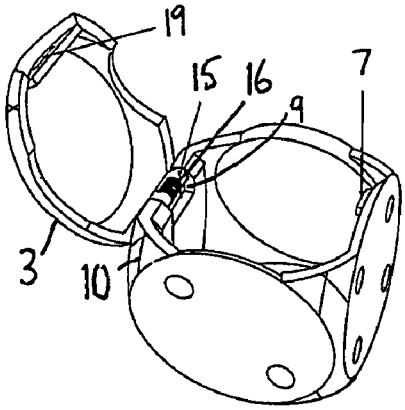
FIG. 2 is a perspective view showing the die of FIG. 1 assembled and open.

FIG. 2 shows the die in its assembled state. The die is hollow and an object, such as a prize in the form of a toy, charm, trophy or the like, can be inserted into the die. Hinge pins 17 engage in indentations 13. An end of spring 16 bears against the inside of back face 10 within recess 9 so that the spring biases lid 3 into the open position shown.

Figure 3:
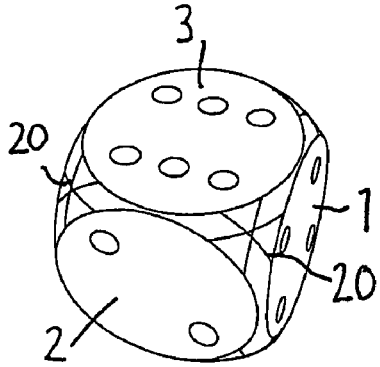
FIG. 3 is a perspective view showing the die in the closed state.

FIG. 3 shows the dice in the closed position in which tongue 7 engages in hole 19 so as to retain lid 3 closed. The die is symmetrical and the gaps between the parts 1, 2, 3 are disguised in that they follow the edges of the circular faces where possible. Where the edges of lid 3 cross the corners of the die, lines 20 are engraved to draw attention away from the joint.

As shown schematically in FIGS. 4*a* and 4*b*, pressure applied to side faces 11 causes cam surfaces 14 inwardly which in turn push cam surfaces 6 and front face 5 outwardly. This releases tongue 7 from hole 19, freeing lid 3 which springs open to the position shown in FIG. 2.

It will be appreciated that games can be devised involving the die. In a simple game, using the die shown in the figures, the lid 3 is the "six" face of the die showing that throwing a "six" will win a player a prize concealed within the die. However, the die can bear symbols other than the numbers shown.

Alternative dice may have the form of an octahedron, a dodecahedron, an icosahedron or the like.

The invention claimed is:

1. A hollow die having three separate component parts comprising:

a front-and-base component comprising a front face, a base face, and a flat projection piece, wherein the front face and the base face are attached at right angles to one another, wherein the front face comprises a tongue that extends inward from an upper edge of the front face, wherein the flat projection piece extends upward from the rear of the base face opposite the front face, wherein a recess is formed in an upper edge of the flat projection piece;

a back-and-sides component comprising a back face and two side faces, wherein the two side faces are opposite one another and are attached at right angles to the back face, wherein a recess is formed in an upper edge of the back face; and an opening face component, wherein hinging means are attached at a rear edge of the opening face, wherein a latch plate with an opening is attached at a front edge of the opening face;

wherein the front-and-base component connects to the back-and-sides component, wherein the two side faces meet the front face and the base face at right angles thereto, wherein the flat projection piece is aligned with and against the back face to be positioned between the back face and the front face;

wherein the opening face detachably connects to the back-and-sides component by the hinging means connecting to the back face and fitting within the flat projection piece recess;

wherein the opening face detachably connects to the front face through engagement of the tongue with the opening.

2. The die of claim 1, wherein the hinging means comprise an axle with a coil spring and hinge pins at each end of the axle, wherein the back face recess comprises indentations, and wherein the hinging means connect to the back face through engagement of the hinge pins with the indentations.

3. The die of claim 1, wherein vertical sides of the front face comprise cam surfaces, wherein vertical sides of the two side faces comprise cam surfaces, wherein the front face cam surfaces align with the side face cam surfaces.

4. The die of claim 3, wherein pressure applied to the two side faces causes the side face cam surfaces to push inward and the front face cam surfaces to push outward.

5. The die of claim 4, wherein the outward push of the front face cam surfaces causes the tongue of the front face to release from the opening of the opening face.

6. The die of claim 1, wherein the front face, base face, two side faces, back face, and opening face are circular with radiused corners.

* * * * *